United States Patent [19]

Yo

[11] Patent Number: 4,573,464

[45] Date of Patent: Mar. 4, 1986

[54] FILTER RESPIRATOR FOR PROTECTION AGAINST SMOKE AND TOXIC GASES

[76] Inventor: Bynyo Yo, 25-9, Kitamagome 2-Chome, Ota-Ku, Tokyo-To, Japan

[21] Appl. No.: 405,161

[22] Filed: Aug. 4, 1982

[30] Foreign Application Priority Data

Aug. 7, 1981 [JP] Japan ..... 56-123614

[51] Int. Cl.[3] ..... A62B 7/10

[52] U.S. Cl. ..... 128/206.15; 128/206.17

[58] Field of Search ..... 128/205.27, 205.28, 128/206.16, 206.17, 206.28, 207.12, 201.25, 205.25, 205.29; 55/72, 387; 423/DIG. 33, DIG. 38, 247

[56] References Cited

U.S. PATENT DOCUMENTS

| | | | |
|---|---|---|---|
| 1,789,262 | 1/1931 | Monro et al. | 55/33 |
| 1,963,874 | 6/1934 | Stampe | 55/33 |
| 3,944,403 | 3/1976 | Simpson et al. | 128/206.17 |
| 4,141,703 | 2/1979 | Mulchi | 128/206.15 |
| 4,179,274 | 12/1979 | Moon | 128/206.17 |
| 4,323,542 | 4/1982 | Joy | 423/247 |

OTHER PUBLICATIONS

Department of the Interior, The Universal and Fireman's Gas Masks, 1923, pp. 4–5.

Hackh's Chemical Dictionary; 4th ed., ed. Grant, 1969, p. 327.

*Primary Examiner*—Henry J. Recla

*Assistant Examiner*—Karin M. Reichle

*Attorney, Agent, or Firm*—Stevens, Davis, Miller & Mosher

[57] ABSTRACT

A discharge valve is provided at the lower side of a smoke-proof, poison-proof respirator, and an opening part is provided at the front face thereof, a filter vessel being detachably fitted in this opening part. The filter vessel constitutes a cylinder having an outer end wall and an inner end wall, and intake openings are formed in both end walls. Within the filter vessel, in successive order from the outer end wall to the inner end wall, an electrostatic smoke-filtering material, an activated carbon fiber material, and a noble-metal catalyst are arranged. Outside gases are sucked in successively through these elements and, finally passing by an intake valve provided in the filter vessel inner end wall, enter the inner side of the respirator.

7 Claims, 3 Drawing Figures

FILTER RESPIRATOR FOR PROTECTION AGAINST SMOKE AND TOXIC GASES

BACKGROUND OF THE INVENTION

This invention relates to a filter respirator for protection against smoke and toxic gases produced at the time of conflagrations and other disasters.

Heretofore, it has been known to provide a smoke-proof respirator in which an intake vessel having a suction or intake valve is inserted into a front face opening of a mask body provided on the lower side with a discharge valve, and within this intake vessel a smoke filtering material such as a prefilter or a main filter (reference: Japanese Utility Model Laid-Open Publication No. 29795/1977).

The above mentioned smoke-proof respirator filters only remove smoke by means of the smoke filtering material, and it is difficult to remove with this respirator organic gases and carbon monoxide (CO) constituting toxic gases generated together with smoke at the time of a fire, for example, whereby this respirator does not function as an effective poison-proof respirator at the time of a fire.

On the other hand, with an ordinary gas mask used at the time of a fire, an air cylinder is always carried on the back of the user, and air in the air cylinder is supplied through a hose to a mask body provided with an inhalation-exhalation valve. The operation and handling of a gas mask of this character are troublesome, requiring the placing of the heavy air cylinder on the user as a back pack and the fitting of the mask body on the user's face, and the entire equipment is cumbersome and heavy and therefore lowers the mobility of the user in an emergency. For these reasons, this type of gas mask is accompanied by the problem of difficulty of emergency evacuation and emergency rescue activity at the time of a fire or some other disaster.

SUMMARY OF THE INVENTION

It is a principal object of this invention to overcome the above described difficulties.

According to this invention, this object is achieved by a respirator for protection against smoke and toxic gases, comprising a respirator body provided with a front opening part and discharge ports, a discharge valve attached over said discharge ports so as to open the discharge ports only when a user wearing the respirator exhales, a filter vessel of cylindrical shape fitted detachably in said front opening part and having an outer end wall and inner end wall respectively with intake holes and ports, an intake valve attached over the intake ports of the inner end wall so as to open said intake ports only when the user wearing the respirator inhales, and, within said filter vessel, in sequence from said outer end wall toward the inner end wall, an electrostatic smoke-filtering material, an activated carbon fiber material, and a noble-metal catalyst.

This invention will now be described in detail with reference to the accompanying drawing showing one embodiment of the invention.

DETAILED DESCRIPTION OF THE INVENTION

Figure 1:
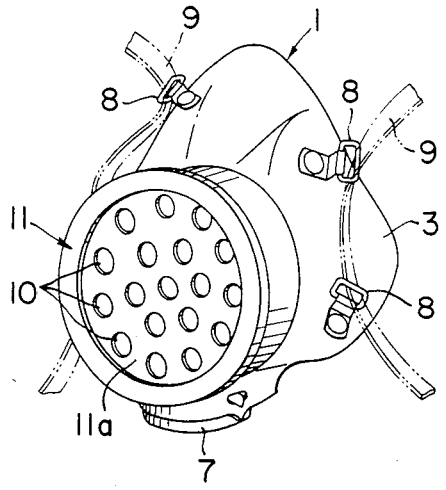
FIG. 1 is a perspective view of a smoke-proof, poison-proof respirator according to this invention.
Figure 2:
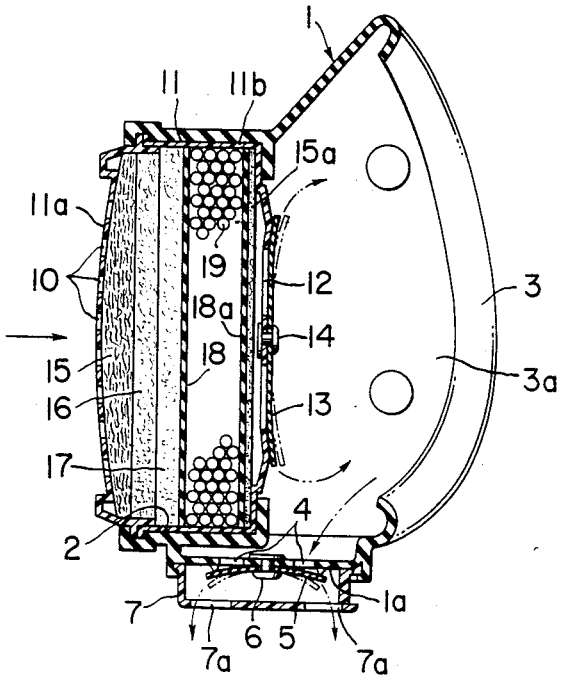
FIG. 2 is a relatively enlarged vertical section of the same respirator.

In FIGS. 1 and 2, reference numeral 1 designates a soft, flexible respirator body, which is formed from a synthetic resin. An opening part 2 is formed at the front face of this respirator body 1, and, at the back face of the respirator body 1 where this opening part 2 is positioned, a face-contacting part 3 is formed. Furthermore, at the lower part 1*a* of this respirator body 1, discharge or exhalation ports 4 are provided. On the lower surface of the outer side of these discharge ports 4, a flexible discharge valve 5 is secured at the central part by a pin 6 in an undetachable manner. Furthermore, a protection cover 7 having discharge holes 7*a* is detachably provided on the outer side of this discharge valve 5.

When the user wearing this respirator exhales, the resulting rise in the internal pressure causes the discharge valve 5 to deflect outward as indicated by chain line, thereby opening the discharge ports 4, and the exhaled discharge gases pass through the discharge ports 4 and the discharge holes 7*a* and are discharged outside.

The respirator body 1, particularly at its face-contacting part 3, is fitted over the nose and mouth of the user and can be secured in place by any known means. In the instant embodiment, the securing means comprises a plurality of strap rings 8 fastened to the outer side of the respirator body 1 in the vicinity of the face-contacting part 3 and one or more straps 9, which may be elastic, are passed through these strap rings 8.

Within the above mentioned opening part 2 of the respirator body 1, a cylindrical filter vessel 11 having numerous intake holes 10 at its outer end wall is detachably fitted. Intake or inhalation ports 12 are formed in the inner end wall of this filter vessel 11. Further, over the inner side of these intake ports 12, a flexible intake valve 13 is secured at its center by a pin 14 to the inner end wall of the filter vessel 11.

When the user wearing the respirator exhales and the above described discharge valve 5 is opened, the intake valve 13 is closed as indicated by solid line. On the other hand, when the user inhales, the intake valve 13 opens as indicated by chain line, and simultaneously the discharge valve 5 is closed.

The filter vessel 11 is so constructed that it can be divided into two parts, namely, a cover structure 11*a* having the end wall with the intake holes 10 and a vessel body 11*b* having the end wall with the intake ports 12. After these two parts have been fitted together, they are formed into an integral assembly by means of an adhesive.

The filter vessel 11 accommodates therewithin, in sequence from its outer side to its inner side, a filter pad 15 made of an unwoven fabric, an electrostatic smoke-filtering material 16 such as an electrostatic fiber smoke-filtering material, an activated carbon fiber material (felt-like carbon fiber material) 17, a thin sponge sheet material 18, a noble-metal catalyst 19, a thin sponge sheet material 18*a*, and a filter disk 15*a* made of an unwoven fabric.

The filter pad 15 and the filter disk 15*a* are constituted by, for example, synthetic fibers, while the sponge sheet materials 18 and 18*a* are constituted by, for example, a synthetic resin material.

The electrostatic smoke-filtering material 16 is, for example, an unwoven fabric of a synthetic fiber which has been charged over a long period with static electricity and is capable of collecting and adsorbing with high efficiency minute particles of smoke of the order of approximately 0.1 micron. It is ordinarily called an "electret filter". Furthermore, because of the high efficiency of this electrostatic smoke-filtering material 16 in adsorbing minute particles of smoke, it is accommodated with small bulk within the limited interior of the filter vessel 11. Moreover, since the resistance to inhalation is low, respiration can be carried out smoothly.

It should be mentioned that this electrostatic smoke-filtering material 16 may be constituted by any kind of fiber provided that it is a fibrous material charged with static electricity. One example is glass fiber.

The activated carbon fiber material 17 functions to adsorb and filter out organic gases generated at the time of a fire. Moreover, this filter material 17 has an extremely high adsorption rate and effectively adsorbs a wide range of miscellaneous gases.

Figure 3:
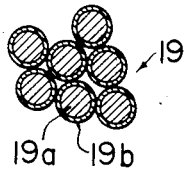
FIG. 3 is an enlarged cross section of a noble-metal catalyst incorporated in the smoke-proof, poison-proof respirator of this invention.

The noble-metal catalyst 19, as shown in FIG. 3, is in the form a large number of units, each of which comprises a particle of alumina 19*a* and a coating of a noble metal 19*b* such as, for example, platinum or gold. This noble-metal catalyst 19 is capable of changing carbon monoxide (CO) to carbon dioxide ($CO_2$) thereby to eliminate toxicity. Particularly since this noble-metal catalyst 19 has an effective oxidizing action at room temperat,ure, it can effectively oxidize CO to $CO_2$ at low temperatures.

Accordingly, when a user places the smoke-proof, poison-proof respirator according to this invention on his face at the time of a fire and begins to breathe, inhalation causes a pressure difference which causes gases accompanied by smoke to flow through the intake holes 10 into the filter vessel 11. The smoke and organic gases thus flowing into the filter vessel 11 are completely adsorbed and filtered by the above described electrostatic smoke-filtering material 16 and activated carbon fiber material 17. The gases thus filtered still contain CO, which is then changed into $CO_2$ by the noble-metal catalyst 19 and thus rendered nontoxic. The gases thus filtered and detoxified flow through the intake port 12 opened by the intake valve 13 to flow into the space 3*a* within the respirator body 1 and bordered by the face-contacting part 3 and thus to be inhaled by the user of the respirator. At his time, outside gases are not sucked in through the discharge ports 4.

Then, when the user exhales, the intake valve 13 is closed, while the discharge valve 5 is simultaneously opened, and the gases thus exhaled is discharged through the discharge ports 4 to the outside.

The noble-metal catalyst 19 comes into contact with only the gases from which smoke and organic gases (miscellaneous gases) have been completely removed by adsorption by the electrostatic smoke-filtering material 16 and the activated carbon fiber material 17. For this reason, this catalyst 19 loses very little of its oxidizing capability as a catalyst and therefore can function effectively over a long period. This is a very important feature.

For high-temperature gases such as exhaust gases of motor vehicles, there are effective oxidizing catalysts, but these exhibit effectiveness only at high temperatures. In contrast, the noble-metal catalyst 19 used in this invention, while functioning effectively at room temperature, has the drawback of being adversely affected by smoke, its effectiveness being rapidly reduced when it contacts smoke. However, since the electrostatic smoke-filtering material 16 and the activated carbon fiber material 17 are positioned in front of, or upstream from, this noble-metal catalyst 19, the effectiveness of this catalyst is always maintained at a high level.

In addition, the filter pad 15 and the filter disk 15*a* further filter the inhaled outside gases. Furthermore, the sponge sheet materials 18 and 18*a* have the function of filtering and, at the same time, the function of preserving the noble-metal catalyst 19.

As described above, the smoke-proof, poison-proof respirator of this invention not only functions at the time of a fire or some other disaster to effectively and suitably filter toxic gases and smoke thereby to change them into harmless gases but also has advantageous features such as small size, light weight, and simple handling and operation, whereby it is effective when used in emergency evacuation and emergency rescue activities at the time of a fire.

What is claimed is:

1. A respirator for protection against smoke and toxic gases, comprising a respirator body having means to cover the breathing passages of a user, means for attachment of said body to the head of a user, said body defining with the head of a user a breathing cavity, said body being provided with an inlet opening communicating the breathing cavity to a source of smoke and toxic gases, said opening shaped to detachably receive a cylindrical filter vessel, said body also having discharge ports, a discharge valve means attached over said discharge ports so as to open the discharge ports only when the user wearing the respirator exhales, a cylindrical filter vessel, said filter vessel being detachably received in said opening and further comprising an outer end wall with intake holes adjacent said source of gases and an inner end wall with intake ports adjacent said breathing cavity, an intake valve means attached over the intake ports of the inner end wall so as to open said intake ports only when the user wearing the respirator inhales, a noble-metal oxidizing catalyst disposed within said filter vessel adjacent to said inner end wall, an electrostatic smoke-filtering material comprising an unwoven fiberous material which has been subjected to electrostatic charging treatment, and an activated carbon fiber material, said smoke-filtering material and activated carbon fiber material being disposed within said filter vessel upstream from said noble-metal catalyst with respect to the flow of smoke and toxic gases from said intake holes to said intake ports, whereby smoke is prevented from arriving at the noble-metal catalyst.

2. A respirator according to claim 1 in which a filter made of an unwoven fabric is interposed between the electrostatic smoke-filtering material and the outer end wall of the filter vessel.

3. A respirator according to claim 1 or 2 including a filter made of an unwoven fabric and a layer of sponge sheet material interposed between the inner side of the noble-metal catalyst and the inner end wall of the filter vessel.

4. A respirator according to claim 1 in which the noble-metal catalyst comprises a plurality of alumina particles and a noble metal cover enveloping each of said alumina particles.

5. A respirator according to claim 1, 4 or 2, further comprising thin sponge sheet materials and the noble-metal catalyst is held between said thin sponge sheet materials.

6. A respirator according to claim 1 in which the discharge ports are disposed on the lower side of the respirator body.

7. A respirator according to claim 1 in which the filter vessel comprises a cover structure having the outer end wall and a vessel body having the inner end wall, and said cover structure and said vessel body are mutually fitted together in a separable manner.

* * * * *